US011299891B1

(12) United States Patent
Nelson et al.

(10) Patent No.: US 11,299,891 B1
(45) Date of Patent: Apr. 12, 2022

(54) THERMAL ISOLATION GIRTS AND RELATED SYSTEMS AND METHODS

(71) Applicant: Knight Wall Systems, Deer Park, WA (US)

(72) Inventors: Brian Nelson, Spokane, WA (US); Shane Knott, Clayton, NC (US)

(73) Assignee: Knight Wall Systems, Deer Park, WA (US)

( * ) Notice: Subject to any disclaimer, the term of this patent is extended or adjusted under 35 U.S.C. 154(b) by 0 days.

(21) Appl. No.: 17/106,704

(22) Filed: Nov. 30, 2020

(51) Int. Cl.

| | |
|---|---|
| ***E04F 13/08*** | (2006.01) |
| ***E04B 2/96*** | (2006.01) |
| ***E04C 3/09*** | (2006.01) |
| ***E04B 1/76*** | (2006.01) |
| *E04C 3/04* | (2006.01) |

(52) U.S. Cl.
CPC ..... *E04F 13/0826* (2013.01); *E04B 1/765* (2013.01); *E04B 2/967* (2013.01); *E04C 3/09* (2013.01); *E04C 2003/0473* (2013.01)

(58) Field of Classification Search
CPC ..... E04B 1/765; E04B 1/4178; E04B 1/7616; E04B 2/789; E04B 2/885; E04B 2/88; E04B 2/96; E04B 2/967; E04B 2/90; E04B 2001/405; E04F 13/0826; E04F 13/0846; E04F 19/061; E04F 19/062; E04F 19/02; E04F 2013/065; E04F 2013/066; E04C 3/09; E04C 2003/0473
See application file for complete search history.

(56) References Cited

U.S. PATENT DOCUMENTS

| | | | | |
|---|---|---|---|---|
| 777,334 | A * | 12/1904 | Dieterich | E04B 1/185 52/283 |
| 1,624,121 | A * | 4/1927 | Thiem | E04F 13/06 52/371 |
| 2,245,785 | A * | 6/1941 | Jentzer, Jr. | E04F 13/0803 52/416 |
| 2,832,102 | A * | 4/1958 | Amoruso | E04F 13/0826 52/386 |
| 5,501,050 | A * | 3/1996 | Ruel | E04F 13/0864 52/283 |
| 5,675,955 | A | 10/1997 | Champagne | |
| 5,860,257 | A * | 1/1999 | Gerhaher | E04F 10/10 52/235 |
| 6,402,419 | B1 * | 6/2002 | Watanabe | E04F 13/0846 403/381 |
| 8,429,866 | B2 | 4/2013 | Knight et al. | |
| 8,979,052 | B2 * | 3/2015 | Uota | E04F 13/0846 248/231.81 |
| 9,695,596 | B2 * | 7/2017 | McIntosh | E04C 2/38 |

(Continued)

FOREIGN PATENT DOCUMENTS

| | | | | |
|---|---|---|---|---|
| DE | 102011117699 | A1 * | 5/2013 | E04C 3/09 |
| FR | 2526837 | A1 * | 11/1983 | E04F 13/0878 |
| WO | WO-2013097121 | A1 * | 7/2013 | E04F 13/06 |

*Primary Examiner* — Jessie T Fonseca
(74) *Attorney, Agent, or Firm* — Elevated IP, LLC

(57) ABSTRACT

Girts, systems incorporating girts, and methods of using girts are disclosed. In some embodiments, the girts are formed via an efficient metal stamping and folding process. The girts have a high mechanical strength, are easily manufactured, allow for water drainage and air circulation, improve thermal performance, decrease sound transmission, and reduce material, transportation and labor costs relative to traditional girts.

18 Claims, 7 Drawing Sheets

(56) References Cited

U.S. PATENT DOCUMENTS

| | | | | |
|---|---|---|---|---|
| D800,921 | S * | 10/2017 | Apanovich | D25/119 |
| 10,221,574 | B2 | 3/2019 | Krause | |
| RE47,495 | E * | 7/2019 | MacKenzie | E04B 1/7076 |
| 2002/0050111 | A1* | 5/2002 | Hikai | E04F 13/0864 52/546 |
| 2005/0189723 | A1 | 9/2005 | Chassee | |
| 2007/0151190 | A1* | 7/2007 | Huff | E04F 13/14 52/592.5 |
| 2013/0205696 | A1* | 8/2013 | Little | E04F 13/073 52/255 |
| 2017/0342723 | A1* | 11/2017 | Krause | E04F 13/0846 |
| 2018/0058063 | A1 | 3/2018 | Delfino | |

* cited by examiner

THERMAL ISOLATION GIRTS AND RELATED SYSTEMS AND METHODS

CROSS-REFERENCE TO RELATED APPLICATIONS

None.

BACKGROUND

Traditionally, construction girts are heavy, welded or forged, steel components that have few, if any, holes. These characteristics are intended to provide the highest possible mechanical strength, but they also limit ease of manufacture, water drainage, air circulation, adaptability, and material, transportation and labor costs.

These drawbacks are expanded to include poor thermal characteristics when one considers modern construction techniques for improved energy efficiency. For example, when adding a thermal barrier to the exterior of a building's envelope it is extremely important that the brackets and fasteners securing the insulation and cladding to the walls limit thermal bridging between the inside and outside environments. Otherwise, a significant portion of the insulative value from the thermal barrier is lost through conductive heat transfer. Traditional metal girts and screws suffer from high thermal conductivity.

Of course, various specialized brackets and fasteners are known. See, e.g., U.S. Pat. Nos. 10,221,574, 8,429,866, and 5,675,955 and US Patent Pub. Nos. 2018/0058063 and 2005/0189723. However, none of these components provide the configuration, mechanical strength, thermal isolation characteristics, ease of manufacture, or other benefits of the girts disclosed herein.

SUMMARY

The present invention provides girts, systems incorporating girts, and methods of making and using girts. In some embodiments, the girts are formed via a metal stamping and folding process. The girts have a high mechanical strength, are easily manufactured, allow for water drainage and air circulation, improve thermal performance, decrease sound transmission, and reduce material, transportation and labor costs relative to traditional girts.

Systems incorporating the disclosed girts may be used to reclad the exterior of new and renovated buildings with structures incorporating steel studs, wood studs, cross laminated timber (CLT), concrete masonry units (CMU), concrete and/or red clay brick. Such systems may reduce field installation time, accommodate and retain the insulation in place, provide firm and continuous pressure against a moisture/air barrier for better sealing of penetrations at wall anchors, and reduce the amount of thermal bridging introduced within the wall assembly versus traditional designs using metal Z-furring, metal hat channels, thereby increasing the energy efficiency of the building.

Cladding that can be accommodated and supported by the disclosed systems includes, but is not limited to, metal panels, composite panels, fiber cement panels, terra cotta panels, 3-coat stucco, high-pressure laminate panels, stone panels and concrete panels. Secondary rails may be attached to the disclosed girts for indirect attachment of cladding finishes, in some embodiments.

In an aspect, a girt comprises substantially parallel, offset upper and lower walls separated by a substantially perpendicular wall, wherein the lower wall comprises an overhanging portion and a doubled-back portion that is joined to a first edge of the perpendicular wall, and wherein an opposite edge of the perpendicular wall is joined to a bottom edge of the upper wall.

In an embodiment, the overhanging portion and the doubled-back portion are connected through a substantially 180 degree bend, or a substantially 190 degree bend, or a substantially 170 degree bend, or a substantially 160 degree bend, or a substantially 150 degree bend, or a substantially 140 degree bend.

In an embodiment, the overhanging portion and the doubled-back portion of the lower wall comprise substantially touching surfaces, or partially touching surfaces, or touching surfaces.

In an embodiment, the lower wall comprises a second doubled-back portion. In an embodiment, the overhanging portion and the second doubled-back portion of the lower wall comprise substantially touching surfaces, or partially touching surfaces, or touching surfaces. In an embodiment, the overhanging portion and the second doubled-back portion are connected through a substantially 180 degree bend, or a substantially 190 degree bend, or a substantially 170 degree bend, or a substantially 160 degree bend, or a substantially 150 degree bend, or a substantially 140 degree bend. In an embodiment, the second doubled-back portion extends toward the first edge of the perpendicular wall. In an embodiment, the second doubled-back portion is on the same side of the overhanging portion as the doubled-back portion. In an embodiment, the second doubled-back portion is on the opposite side of the overhanging portion as the doubled-back portion.

In an embodiment, the upper wall is rectilinear. In an embodiment, the upper wall comprises a plurality of mounting holes for receiving fasteners. In an embodiment, the mounting holes are elongated holes.

In an embodiment, the girt is formed of folded metal. In an embodiment, the girt consists of folded metal. In an embodiment, the girt comprises corrugated material, such as rigidized steel or rigidized stainless steel. In an embodiment, a girt is contiguous and made of a material selected from the group consisting of steel, stainless steel, carbon fiber, aluminum, plastic, fiber reinforced polymer (e.g., fiberglass) and combinations thereof. In some embodiments, girts are formed with continuous profiles up to 100 feet, or up to 50 feet, or up to 25 feet, or up to 20 feet in length.

In an embodiment, the perpendicular wall comprises a plurality of holes. In an embodiment, the plurality of holes comprises neighboring holes offset relative to one another along a longitudinal axis of the perpendicular wall. In an embodiment, the amount of material in the perpendicular wall is reduced by about 15-50% relative to a perpendicular wall with no holes. Including a plurality of holes in the perpendicular wall may allow water and moisture to escape the system, reduce the amount of material or weight of the girt, improve thermal performance and/or decrease sound transmission through the component.

In an aspect, a system for cladding an exterior wall of a structure and insulating the structure wall comprises: first and second girts fastened to the structure wall in spaced array; thermally insulating material positionally maintained adjacent the structure wall by the first and second girts; and exterior cladding for the structure supported by the first and second girts; wherein the first and second girts are girts as described herein.

In an embodiment, the thermally insulating material is rigid. In an embodiment, the thermally insulating material comprises a top notch/slit/kerf configured to mate with the overhanging portion of the first girt and a bottom notch/slit/kerf configured to mate with the doubled-back portion of the second girt. In an embodiment, the thermally insulating material at least partially encapsulates the first and second girts. In an embodiment, the thermally insulating material completely encapsulates the first and second girts.

In an embodiment, the exterior cladding is fastened directly or indirectly to the girts. In an embodiment, the exterior cladding is fastened through the doubled-back portion. In an embodiment, the exterior cladding is fastened through the thermally insulating material. In an embodiment, the exterior cladding is fastened through the thermally insulating material and the doubled-back portion.

In an embodiment, a perpendicular wall has a depth of about 0.75 inches to about 6 inches. In an embodiment, the depth of the girt is less than the thickness of insulation by about 0.25 inches to 0.5 inches. In an embodiment a height of the lower wall is between about 1.5 inches and 2 inches. In an embodiment, a height of the doubled-back portion is about half the overall height of the lower wall. In an embodiment, the height of the overhanging portion is equal to the overall height of the lower wall. In an embodiment, a height of the upper wall is between about 1.5 inches and 2 inches.

In an embodiment, the system provides a continuously insulated wall assembly that satisfies the ASHREA 90.1 definition for continuous insulation.

In an aspect, a method of using a girt comprises: placing a girt described herein with a back surface of its upper wall abutting an exterior wall of a structure; applying fasteners through mounting holes of the upper wall into the exterior wall; securing a second girt a specified distance from the first girt; and installing thermally insulating material between the girts, wherein at least a portion of the thermally insulating material covers a front surface of the first and second girts.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "system" is a combination of components operably connected to produce one or more desired functions.

A "component" is used broadly to refer to an individual part of a system.

The terms "direct and indirect" describe the actions or physical positions of one component relative to another component. For example, a component that "directly" acts upon or touches another component does so without intervention from an intermediary. Contrarily, a component that "indirectly" acts upon or touches another component does so through an intermediary (e.g., a third component).

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

"Offset" refers to the relative positions of two objects separated from one another in at least two dimensions. In an embodiment, when each object is defined by a three-dimensional coordinate system that is positioned at a common location for each object (e.g., top right or left corner, center of a face, center of a body), at least two axes of one object's coordinate system are physically separate from the same two axes of the other object's coordinate system.

"Contiguous" refers to materials or layers that are touching or connected throughout in an unbroken sequence.

Girts disclosed herein may be manufactured by techniques including, but not limited to, metal rolling, metal stamping, welding, laser cutting, computer numerical control (CNC) machining, additive manufacturing, injection molding, extruding, casting and combinations thereof.

Exemplary girts can be seen in FIGS. 1-10, which are described hereafter.

Figure 1:
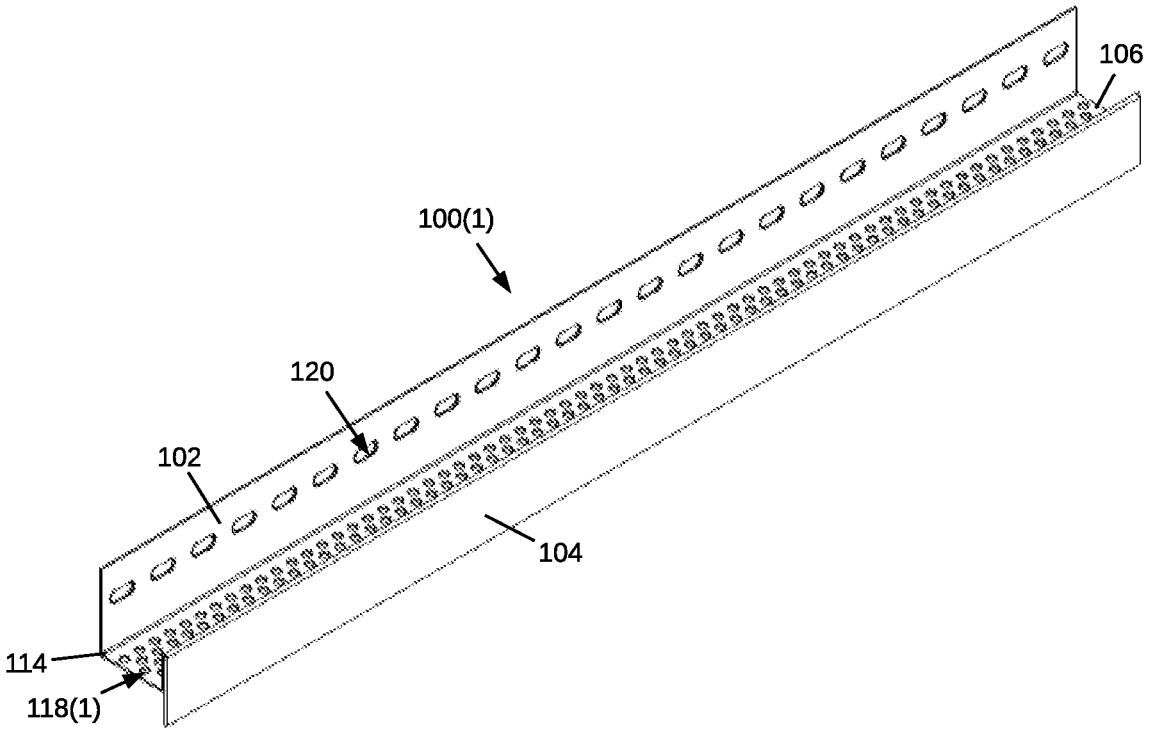
FIG. 1 provides a top perspective view of a girt, according to an embodiment.
Figure 2:
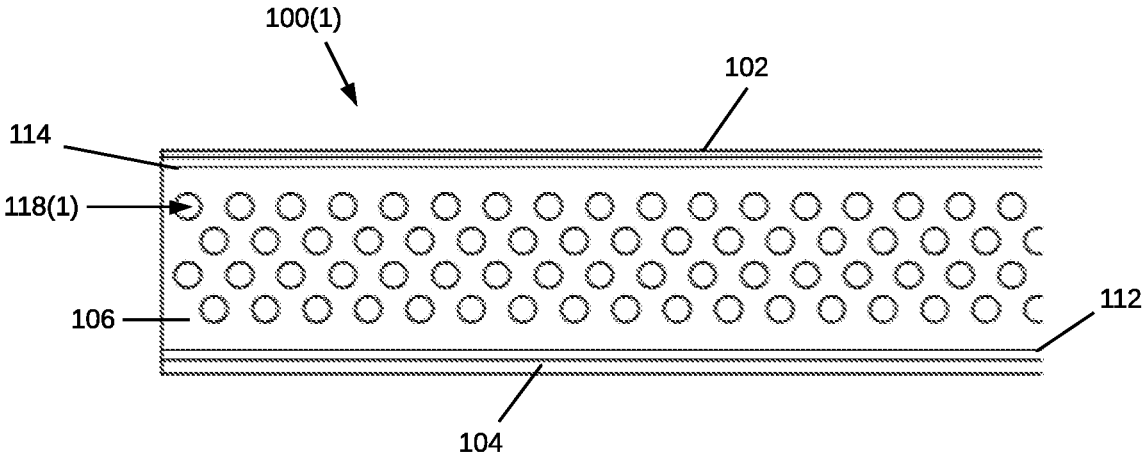
FIG. 2 provides a top plan view of the girt of FIG. 1.
Figure 3:
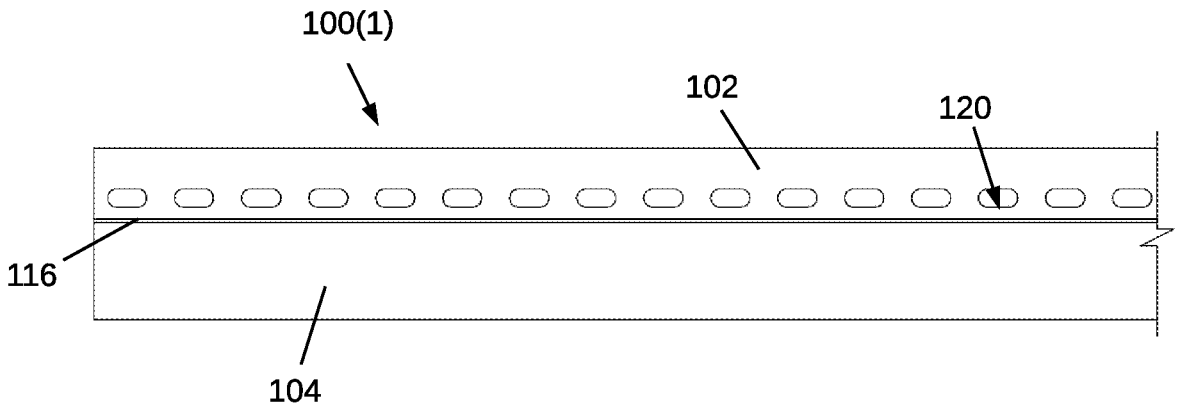
FIG. 3 provides a front plan view of the girt of FIGS. 1-2.
Figure 4:
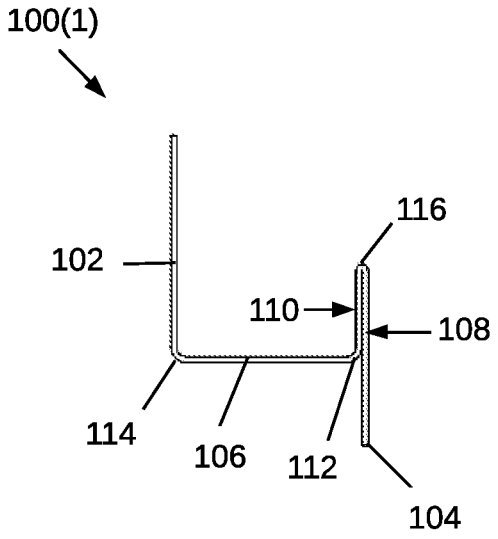
FIG. 4 provides a left side plan view of the girt of FIGS. 1-3.
Figure 5:
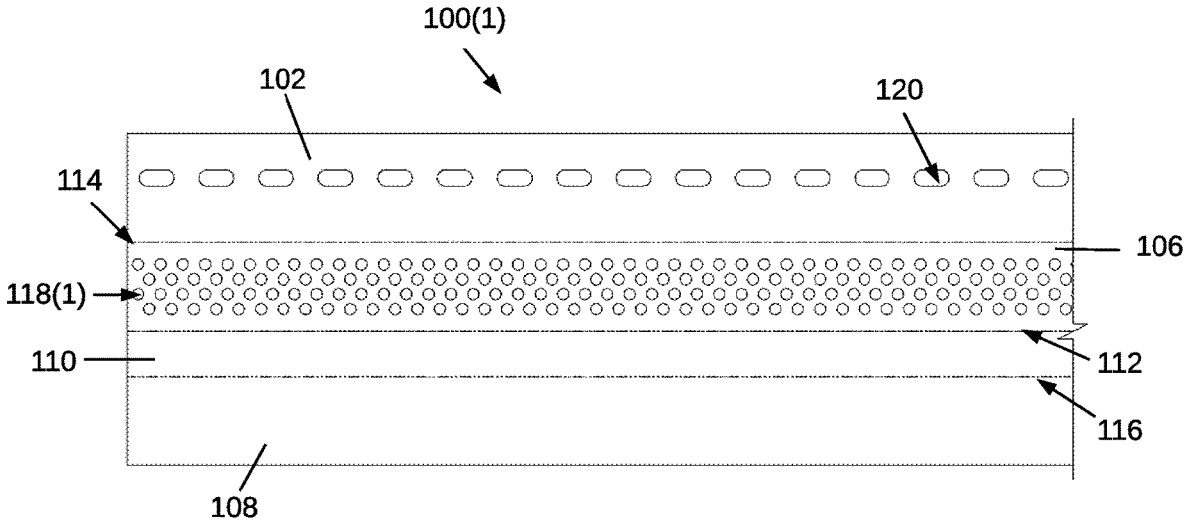
FIG. 5 provides a plan view of the material used to form the girt of FIGS. 1-4 prior to folding of the material.

FIG. 1 provides a top perspective view of a girt 100(1); FIG. 2 provides a top plan view of girt 100(1); FIG. 3 provides a front plan view of girt 100(1); and FIG. 4 provides a left side plan view of girt 100(1). FIG. 5 provides a plan view of the material used to form girt 100(1) prior to folding of the material.

With respect to FIGS. 1-4, girt 100(1) comprises substantially parallel, offset upper wall 102 and lower wall 104 separated by a substantially perpendicular wall 106. Lower wall 104 comprises an overhanging portion 108 and a doubled-back portion 110 that is joined to a first edge 112 of perpendicular wall 106. An opposite edge of perpendicular wall 106 is joined to a bottom edge 114 of upper wall 102. As shown, overhanging portion 108 and doubled-back portion 110 are connected through a bend 116 that is approximately 180 degrees. In the embodiment shown, girt 100(1) includes a plurality of holes 118(1) in perpendicular wall 106 such that, when girt 100(1) is used in a horizontal orientation, water and moisture can escape the system, overall mass of the girt is reduced, thermal performance is improved, and sound transmission through the system is decreased. Holes 118(1) also reduce the amount of material needed to produce the girt, thereby decreasing material costs and weight of the final product, which may decrease manufacturing and shipping costs. In addition, upper wall 102, optionally, includes a plurality of mounting holes 120 for receiving fasteners used to secure the girt to a surface, such as an exterior wall of a structure. Cladding, or other objects, may be secured to girt 100(1), e.g., through lower wall 104.

Figure 6:
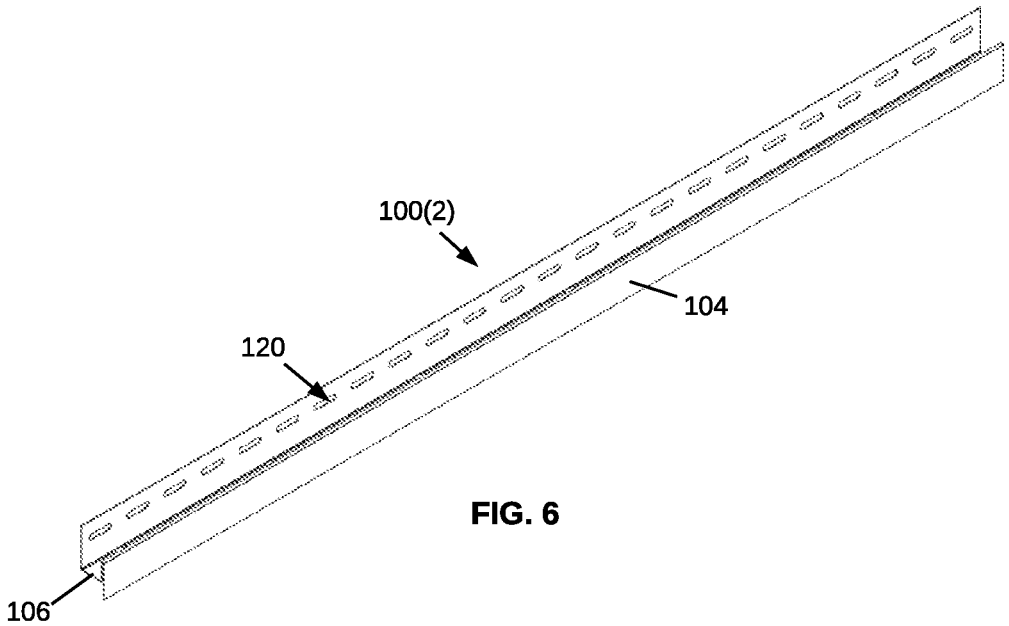
FIG. 6 provides a top perspective view of a girt, according to an embodiment.
Figure 7:
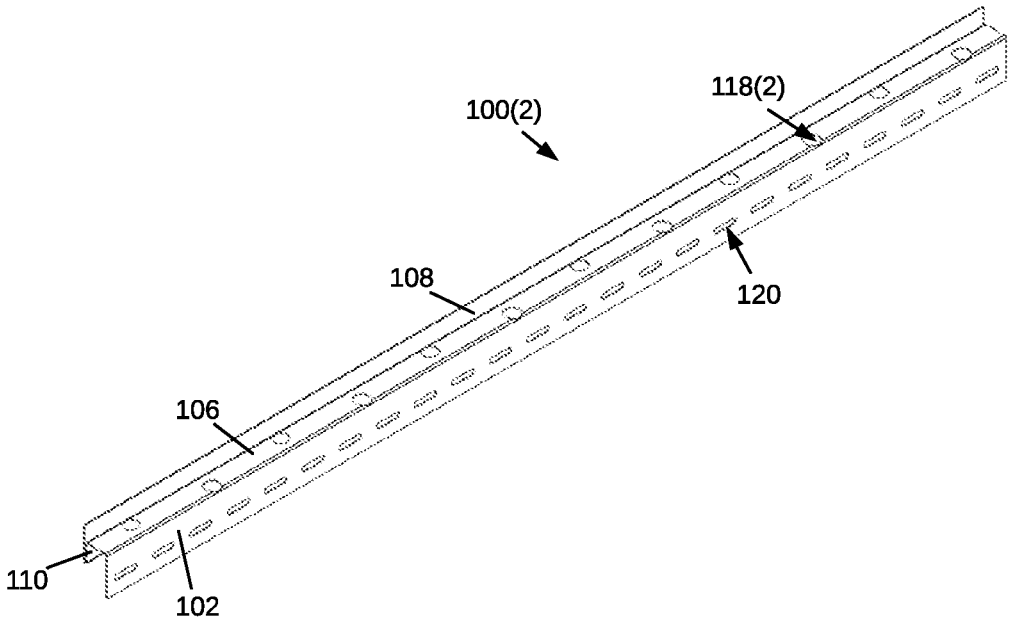
FIG. 7 provides a bottom perspective view of the girt of FIG. 6.

FIG. 6 provides a top perspective view of a girt 100(2) and FIG. 7 provides a bottom perspective view of girt 100(2). Girt 100(2) is similar to girt 100(1) except that the plurality of holes 118(2) in perpendicular wall 106 of girt 100(2) has a different pattern than the plurality of holes 118(1) of girt 100(1). In other embodiments, perpendicular wall 106 may comprise other hole patterns (not shown) or perpendicular wall 106 may not include any holes (i.e., perpendicular wall 106 may be solid).

Figure 8:
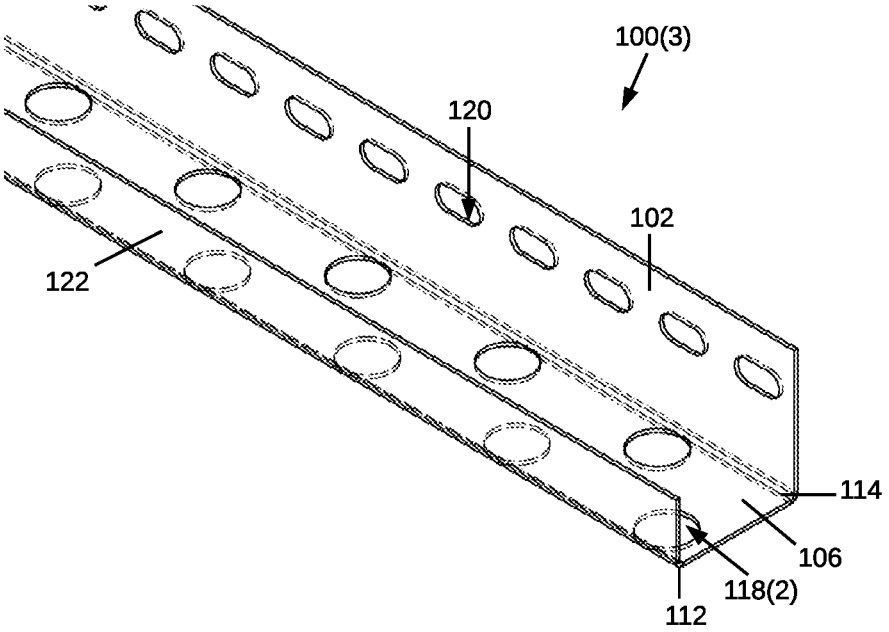
FIG. 8 provides a top perspective view of a girt, according to an embodiment.

FIG. 8 provides a top perspective view of a girt 100(3). Girt 100(3) is similar to girt 100(2) except that lower wall 122 of girt 100(3) does not comprise an overhanging portion or a doubled-back portion. As discussed above, perpendicular wall 106 may comprise an alternate hole pattern or no holes.

Figure 9:
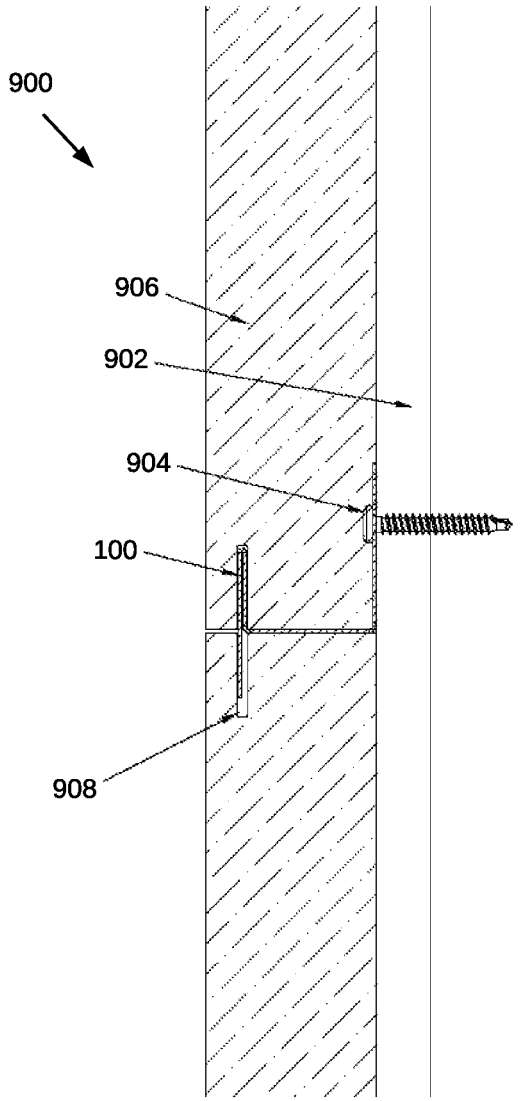
FIG. 9 provides an enlarged side view of a girt used in a system for cladding and insulating an exterior wall of a structure, according to an embodiment.

FIG. 9 provides an enlarged side view of a girt 100 used in a system 900 for cladding and insulating an exterior wall 902 of a structure. As shown, girt 100 is screwed into exterior wall 902 with a fastener 904 through a mounting hole 120. Thermally insulating material 906, which may be rigid insulation, abuts girt 100 and a slot/notch/kerf 908 within insulation 906 allows the insulation to at least partially encapsulate the lower wall of the girt. For example, the lower wall of girt 100 may slide into notch(es) 908, and a snug fit between the girt and insulation allows the thermally insulating material 906 to be retained in place.

Figure 10:
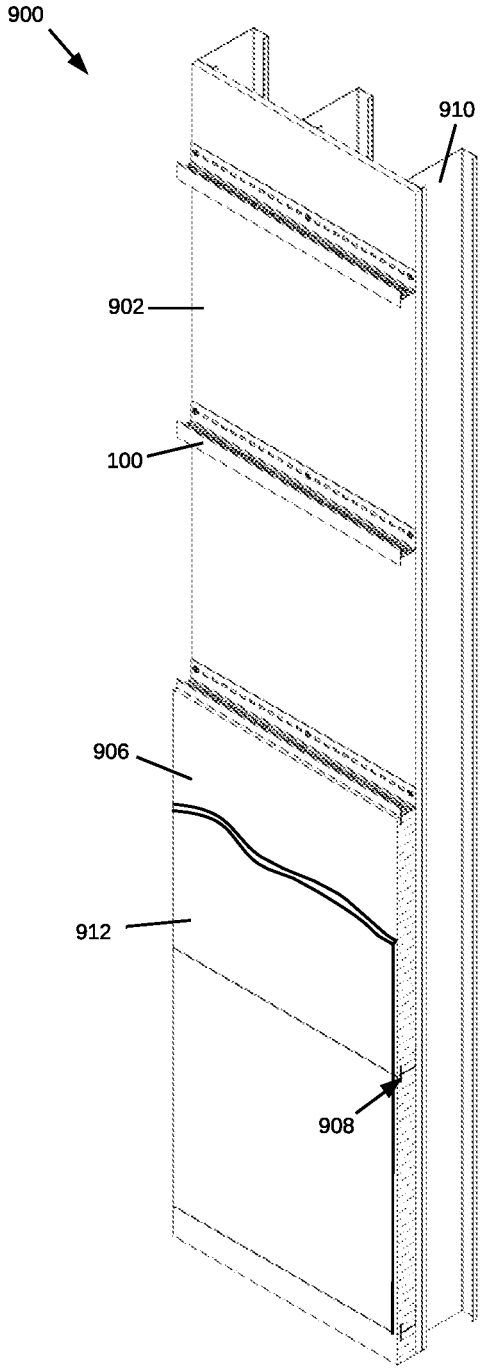
FIG. 10 provides a cutaway view of a system for cladding and insulating an exterior wall of a structure using one or more of the disclosed girts, according to an embodiment.

FIG. 10 provides a cutaway view of a system 900 for cladding and insulating an exterior wall 902 of a structure using one or more of the disclosed girts, according to an embodiment. Ordinarily, the exterior wall 902 of a structure is joined to an inner wall of the structure, such as drywall, through a plurality of studs 910. System 900 comprises thermally insulating material 906 positionally maintained adjacent exterior wall 902 by plural girts 100 fastened to studs 910 or wall 902 in spaced horizontal array. As shown, thermally insulating material 906 comprises top and bottom notches/slits/kerfs 908 configured to mate with the overhanging portion of a first girt and a doubled-back portion of a second girt, such that the thermally insulating material partially or completely encapsulates the first and second girts. Exterior cladding 912 for the structure may be fastened directly or indirectly to the girts. For example, exterior cladding 912 may be fastened through thermally insulating material and the lower wall of the girt to reduce thermal transfer through the girt and subsequently the wall assembly. The fastener may penetrate the overhanging portion and optionally the doubled-back portion to achieve increased mechanical strength. In some embodiments, a girt may comprise a second doubled-back portion below the perpendicular wall. In addition, systems employing the disclosed girts in vertical, or both vertical and horizontal, orientations are contemplated.

Statements Regarding Incorporation by Reference and Variations

All references cited throughout this application, for example patent documents including issued or granted patents or equivalents; patent application publications; and non-patent literature documents or other source material; are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a fastener" includes a plurality of such fasteners and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A system for cladding an exterior wall of a structure and insulating the exterior wall, the system comprising:

first and second girts fastened to the exterior wall in spaced array;

thermally insulating material positionally maintained adjacent the exterior wall by the first and second girts; and exterior cladding for the structure supported by the first and second girts;

wherein each of the first and second girts is a girt comprising substantially parallel, offset upper and lower walls separated by a substantially perpendicular wall that comprises a plurality of holes, wherein the lower wall comprises an overhanging portion and a doubled-back portion that is joined to a first edge of the substantially perpendicular wall, and wherein an opposite edge of the substantially perpendicular wall is joined to a bottom edge of the upper wall.

2. The system of claim 1, wherein the overhanging portion and the doubled-back portion are connected through a substantially 180 degree bend.

3. The system of claim 1, wherein the overhanging portion and the doubled-back portion of the lower wall comprise substantially touching surfaces.

4. The system of claim 1, wherein the upper wall is rectilinear.

5. The system of claim 1, wherein the upper wall comprises a plurality of mounting holes.

6. The system of claim 5, wherein the mounting holes are elongated holes.

7. The system of claim 1, wherein the girt is formed of folded metal.

8. The system of claim 1, wherein the girt consists of folded metal.

9. The system of claim 1, wherein the girt comprises corrugated material.

10. The system of claim 1, wherein the plurality of holes comprises neighboring holes offset relative to one another along a longitudinal axis of the substantially perpendicular wall.

11. The system of claim 1, wherein the thermally insulating material is rigid.

12. The system of claim 1, wherein the thermally insulating material comprises a top notch configured to mate with the overhanging portion of the first girt and a bottom notch configured to mate with the doubled-back portion of the second girt.

13. The system of claim 1, wherein the thermally insulating material at least partially encapsulates the first and second girts.

14. The system of claim 1, wherein the thermally insulating material completely encapsulates the first and second girts.

15. The system of claim 1, wherein the exterior cladding is fastened through the doubled-back portion.

16. The system of claim 1, wherein the exterior cladding is fastened through the thermally insulating material.

17. The system of claim 1, wherein the exterior cladding is fastened through the thermally insulating material and the doubled-back portion.

18. The system of claim 1, wherein the substantially perpendicular wall is a single perpendicular wall.

* * * * *